US005090094A

United States Patent [19]

Bert

[11] Patent Number: 5,090,094

[45] Date of Patent: Feb. 25, 1992

[54] END CONNECTOR WITH INTEGRAL PIVOTAL CLAM SHELL

[75] Inventor: Stephen F. Bert, North Scituate, R.I.

[73] Assignee: Textron Inc., Providence, R.I.

[21] Appl. No.: 619,122

[22] Filed: Nov. 27, 1990

[51] Int. Cl.[5] ..... A44C 5/18
[52] U.S. Cl. ..... 24/265 WS
[58] Field of Search ..... 24/265 WS, 265 B; 224/164, 179, 168; 59/79.1; 368/282

[56] References Cited

U.S. PATENT DOCUMENTS

| | | | |
|---|---|---|---|
| 2,948,941 | 8/1960 | Bruhn et al. | 24/265 B |
| 3,039,263 | 6/1962 | Wyler et al. | 24/265 B |
| 4,837,901 | 6/1989 | Bert | 24/265 WS X |
| 4,949,433 | 8/1990 | Bert | 24/265 WS |
| 4,987,655 | 1/1991 | Bert | 24/265 WS |

FOREIGN PATENT DOCUMENTS

| | | | |
|---|---|---|---|
| 341673 | 11/1959 | Switzerland | 27/265 WS |

*Primary Examiner*—James R. Brittain
*Attorney, Agent, or Firm*—Samuels, Gauthier & Stevens

[57] ABSTRACT

A connector for connecting an end of a watchband to a watchcase, the watchcase having a pair of a spaced lugs defining a gap bridged by a spring bar extending therebetween. The connector has a base member fixed at a rear end to the end of the watch band and forward end pivotally connected to the spring bar. A shell overlies the base number. A forward end of the shell extends beyond the forward end of the base member to fill the gap between the lugs on the watchcase. Lugs depend from a flange at the rear end of the shell to straddle the base member. The lugs have first tabs which connect the shell to the base member for pivotal movement about the axis of the spring bar, and second tabs which coact with the watchcase to resist pivotal movement of the shell about the same axis.

6 Claims, 2 Drawing Sheets

END CONNECTOR WITH INTEGRAL PIVOTAL CLAM SHELL

BACKGROUND OF THE INVENTION

1. Field of the Invention

This invention relates to metallic watchbands, and is concerned in particular with an improved end connector for connecting the ends of such watchbands to conventional spring bars or the like carried on watchcases.

2. Description of the Prior Art

It is known to provide end connectors comprising base members secured at their rearward ends to the watchband ends and at their forward ends to spring bars on the watch cases. It is also known to provide decorative shells (commonly referred to as "clam shells") which overlie the base members and which extend between the end of the watchband and the side of the watchcase.

In some cases, the base members are initially connected to the watchband ends, and the shells are then secured in a fixed relationship to the base members. From a manufacturing and handling standpoint, this is advantageous in that once fixed one to the other, the base members and shells constitute integral assemblies at each end of the watchband. This eliminates the possibility of the shells becoming lost o damaged through mishandling before the watchband is eventually connected to the watchcase. The drawback with this arrangement, however, is that by fixing the shells to the base members, a rigidity is introduced between the watchband ends and the watchcase. This in turn compromises both comfort and appearance.

In other cases, the shells are allowed to pivot in relation to the base members. Here, however, the shells and base members are pivotally interconnected by the spring bars carried by the watch cases. Thus, until the band is assembled to the watchcase, the shells remain separable from the base members, and as such they remain vulnerable to being lost or damaged through mishandling.

SUMMARY OF THE INVENTION

A general objective of the present invention is to provide an improved end connector which capitalizes on the advantages of the prior art connectors while at the same time avoiding or at least significantly minimizing the problems and disadvantages associated therewith.

A more specific object of the present invention is the provision of an end connector wherein the base member and the shell constitute an integral assembly at each end of the watchband, with the shell being pivotable relative to the base member.

These and other objects and advantages of the present invention will become more apparent as the description proceeds with the aid of the accompanying drawings, wherein:

DETAILED DESCRIPTION OF ILLUSTRATED EMBODIMENT

Figure 1:
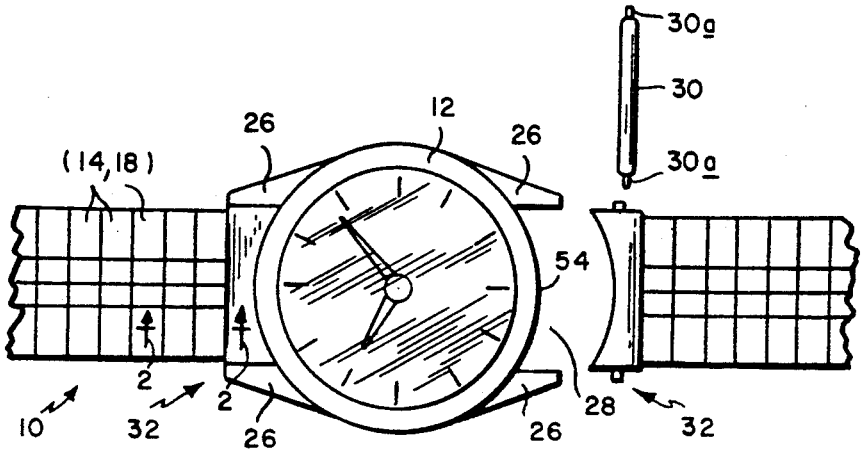
FIG. 1 is a top plan view of a wristwatch embodying end connectors in accordance with the present invention, with one end connector of the watchband disconnected from the watchcase.
Figure 2:
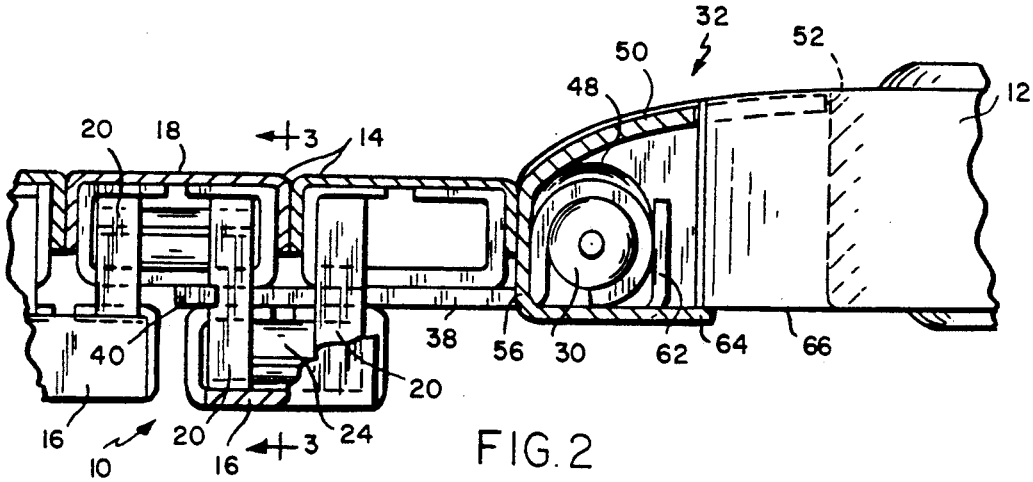
FIG. 2 a sectional view on an enlarged scale taken along line 2—2 of FIG. 1, with portions broken away.
Figure 3:
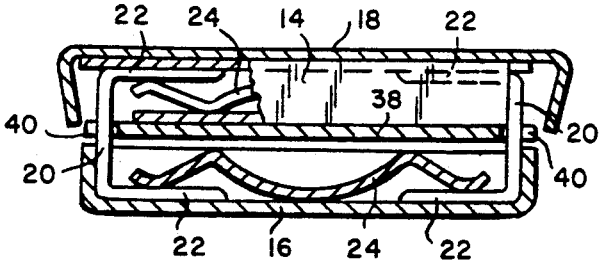
FIG. 3 is a sectional view taken along line 3—3 of FIG. 2.

Referring initially FIGS. 1–3, a conventional expansible watchband 10 is shown connected to a watchcase 12. The watchband has a row of top links 14 overlying a row of bottom links 16. The links have a somewhat box-like structure, with the top links 14 typically being covered by decorative top shells 18. Each bottom link 16 is connected to two adjacent top links 14 by confronting pairs of U-shaped staples 20. The staples have legs 22 (see FIG. 3) protruding into the ends of the links. Leaf springs 24 are housed in the links. The springs 24 act on the staple legs 22 to yieldably contract the band in a manner well known to those skilled in the art.

The watchcase 12 has pairs of lugs 26 protruding from opposite sides thereof to define gaps 28 therebetween. Conventional spring bars or the like 30 extend between the lugs 26 and across the gaps 28.

Figure 4:
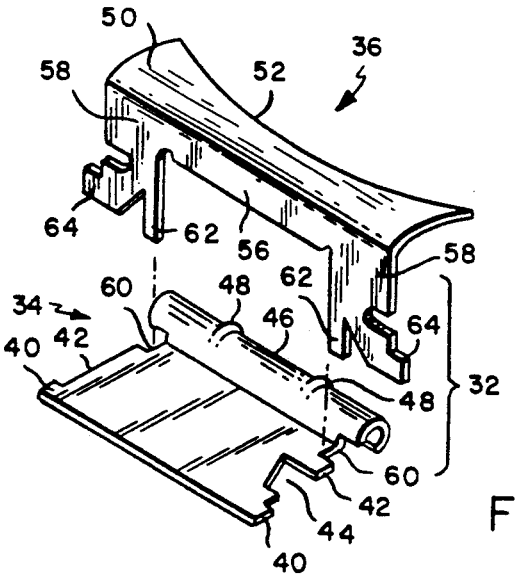
FIG. 4 is an exploded view of the components making up the end connect of the present invention.

The ends of the watchband 10 are connected to the watchcase 12 via the spring bars 30 by means of end connectors generally indicated at 32. With reference additionally to FIG. 4, it will be seen that each end connector 32 includes a base member 34 and a shell 36.

The base member 34 includes a generally planar shank 38 suitably dimensioned for insertion into the end of the band between the top and bottom links 14,16. The shank is provided at its rear end with first engagement means in the form of laterally protruding ears 40. The side edges 42 of the shank are appropriately notched as at 44 and otherwise configured to accommodate manipulation of the shank between the top and bottom links in order to position the ears 40 behind the second pair of staples 20 a shown in FIGS. 2 and 3. This arrangement for connecting the base member to the end of the watchband is further described in U.S. Pat. No. 4,949,433, the disclosure of which is herein incorporated by reference in its entirety.

The base member 34 is further provided at its forward end with a second engagement means in the form of an integrally formed tubular barrel 46. The barrel is formed with a pair of upwardly protruding bosses 48 spaced inwardly from the ends of the barrel.

The shell 36 includes a cover portion 50 overlying the barrel 46 and seated on the bosses 48. The cover portion extends forwardly from the barrel 46 and is provided with a forward edge 52 appropriately configured to follow the contour of the side 54 of the watchcase extending between each pair of lugs 26.

The shell 36 further includes a flange 56 depending from the cover portion 50 and arrange to extend rearwardly along the barrel 46 The flange 56 has downwardly depending legs 58 arranged to straddle the base member 34 and to be engageable within notches 60 in the side edges 42 of the shank 38, the notches 60 being located immediately rearwardly of and directly adjacent to the barrel 46.

The legs 58 are provided with 3rd engagement means in the form of bendable tabs 62 and fourth engagement means in the form of bendable tabs 64.

Figure 5C:
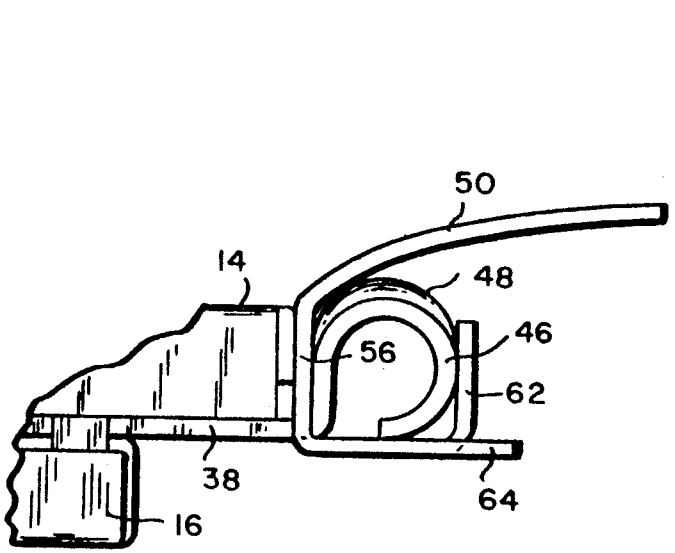
FIGS. 5A, 5B and 5C are sequential sectional views depicting the manner in which the shell is pivotally connected to the base member after the latter has been attached to the end of the watchband.
Figure 5B:
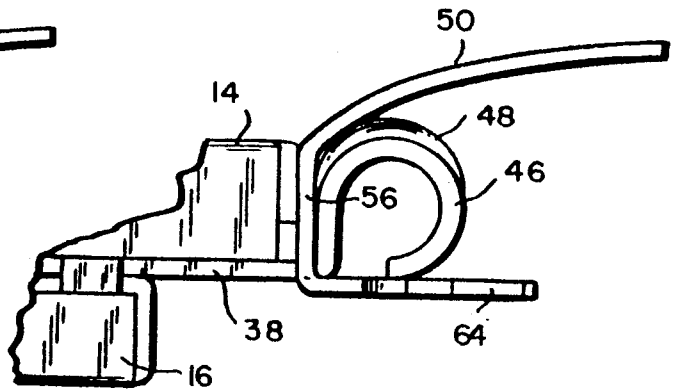
Figure 5A:
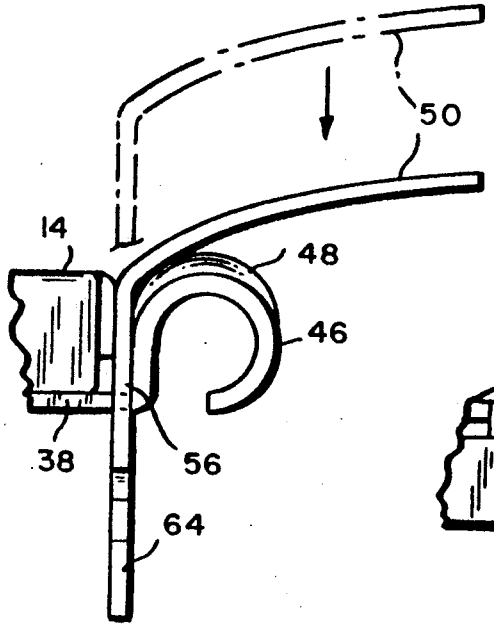

Referring additionally to FIGS. 5A-5C, it will be seen that when assembling the shell 36 to the base member 34, the shell is initially lowered onto the base member to position the legs 58 within the notches 60, with the flange 56 extending along the rear of the barrel 46 and with the cover 50 overlying the barrel 46 and resting on the bosses 48. Thereafter, as shown in FIG. 5B, the legs 58 are bendably deformed to project the tabs 64 under the cover 50 and forwardly of the barrel 46. Thereafter, as shown in FIG. 5C, the tabs 62 are further deformed upwardly to engage the barrel 46. The shell 36 is thus integrally connected to the base member 34 for pivotable movement about the axis of the barrel When connecting the end of the watchband to the watchcase, the spring pin 30 is first inserted into the barrel 46. The spring-loaded ends 30*a* are then axially depressed and the end connector is inserted into the gap 28 between the lugs 26. The spring-loaded ends 30*a* are then allowed to enter aligned holes (not shown) in the lugs 26, thereby mechanically coupling the end of the watchband to the watchcase.

When thus coupled, as shown in FIG. 2, the tabs 64 underlie and engage the bottom surfaces 66 of the lugs 26, and the forward edge 52 of the cover portion 50 abuts the adjacent side 54 of the watchcase. Thus, the shell 36 is constrained from rotating about the axis of the spring bar 30 in relation to the watchcase. However, the base member 34 remains free to pivot about the spring bar 30 relative to the shell 36.

In light of the foregoing, it will now be appreciated by those skilled in the art that the end connector of the present invention is not restricted in use to expansible watchbands. For example, with non-expansible watchbands having links interconnected by pins of the like, the same pin arrangement could be employed to connect the base member to the end most link.

I claim:

1. For use in connecting an end of a watchband to a watchcase, said watchcase having a pair of lugs protruding from a side thereof to define a gap therebetween, with a bar member extending between said lugs and across said gap, an end connector comprising:

a base member;

first engagement means at a rear end of said base member for connecting said base member to the said one end of said watchband;

second engagement means at a forward end of said base member for connecting said base member to said bar member for pivotal movement about the axis thereof;

a shell overlapping said second engagement means, said shell having a rear end overlying said base member and a forward end protruding beyond the forward end of said base member;

a flange at the rear end of said shell, said flange having mutually spaced legs straddling said base member;

third engagement means on said legs, said third engagement means coacting with said second engagement means to interconnect with shell and said base member for relative pivotal movement about said axis; and fourth engagement means on said legs, said fourth engagement means coacting with said watchcase to resist pivotal movement of said shell about said axis relative to said watchcase.

2. The end connector of claim 1 wherein the forward end of said shell forms a cover portion extending forwardly from said second engagement means to occupy said gap.

3. The end of claim 1 or 2 wherein said second engagement means comprises a barrel extending across the width of said base member, and wherein said flange extends rearwardly along said barrel.

4. The end connector of claim 3 wherein said third engagement means comprises tabs on said legs, said tabs being bendably deformable into overlapped engagement with said barrel.

5. The end connector of claim 1 wherein said fourth engagement means comprises tabs on said legs, said tabs being bendably deformable into overlapped engagement with said watchcase.

6. The end connector of claim 1 wherein said base member includes side edges extending between said first engagement means and said barrel, said side edges having notches therein located rearwardly of and adjacent to said barrel, said legs being engageable within said notches.

* * * * *